US010093122B2

(12) United States Patent
Giammarresi et al.

(10) Patent No.: US 10,093,122 B2
(45) Date of Patent: Oct. 9, 2018

(54) BALLOON GREETING

(71) Applicants: Ignazio Giammarresi, Mississauga (CA); Pietro Domenichiello, Mississauga (CA); Carmine Francesco Dodaro, Toronto (CA)

(72) Inventors: Ignazio Giammarresi, Mississauga (CA); Pietro Domenichiello, Mississauga (CA); Carmine Francesco Dodaro, Toronto (CA)

( * ) Notice: Subject to any disclaimer, the term of this patent is extended or adjusted under 35 U.S.C. 154(b) by 0 days.

(21) Appl. No.: 15/892,949

(22) Filed: Feb. 9, 2018

(65) Prior Publication Data

US 2018/0229532 A1 Aug. 16, 2018

Related U.S. Application Data

(60) Provisional application No. 62/457,505, filed on Feb. 10, 2017.

(51) Int. Cl.

| | |
|---|---|
| ***A63H 27/10*** | (2006.01) |
| ***B42D 15/02*** | (2006.01) |
| ***B42D 15/04*** | (2006.01) |

(52) U.S. Cl.

CPC ..... *B42D 15/027* (2013.01); *A63H 27/10* (2013.01); *B42D 15/042* (2013.01); *A63H 2027/1008* (2013.01); *A63H 2027/1033* (2013.01); *A63H 2027/1041* (2013.01); *A63H 2027/1075* (2013.01)

(58) Field of Classification Search

CPC ..... A63H 27/10; A63H 2027/1041; A63H 2027/1075; A63H 2027/1008; A63H 2027/1058; A63H 3/06; A63H 2027/1091

See application file for complete search history.

(56) References Cited

U.S. PATENT DOCUMENTS

| | | | | |
|---|---|---|---|---|
| 4,145,731 | A * | 3/1979 | Adamich | B42D 15/022 229/92.8 |
| 4,349,973 | A | 9/1982 | Penick et al. | |
| D290,823 | S | 7/1987 | Gardiner et al. | |
| 4,910,913 | A | 3/1990 | Streeter | |
| 5,317,823 | A | 6/1994 | Brunt, II | |
| 5,573,437 | A * | 11/1996 | Van Dyke | B42D 15/045 446/176 |
| D390,498 | S | 2/1998 | Reichert | |
| 5,797,783 | A * | 8/1998 | Harris | A63H 27/10 40/124.05 |
| 6,688,023 | B1 * | 2/2004 | Gwen | A44C 3/001 40/1.6 |
| 7,036,271 | B2 | 5/2006 | Hjorth | |
| D542,346 | S * | 5/2007 | Barton | D19/2 |
| 7,395,621 | B2 | 7/2008 | Carter | |
| 7,596,904 | B1 | 10/2009 | Jones | |
| D625,649 | S | 10/2010 | Rooney | |
| 8,650,779 | B1 | 2/2014 | Glass et al. | |
| 8,807,334 | B2 | 8/2014 | Tsai | |
| 9,156,301 | B2 | 10/2015 | Flesher | |

(Continued)

*Primary Examiner* — Cassandra Davis

(57) ABSTRACT

An in store sales product having a greeting card with an uninflated balloon attached. and after purchase the cashier can then inflate the balloon, place the greeting card and balloon in a shopping bag and hand it to the customer and the balloon remains temporarily secured down on the greeting card, and will be released later to float upwards on a tether.

14 Claims, 10 Drawing Sheets

(56) References Cited

U.S. PATENT DOCUMENTS

| | | | | |
|---|---|---|---|---|
| 9,266,383 | B2 | 2/2016 | Patrou et al. | |
| 2006/0005438 | A1 | 1/2006 | Chang et al. | |
| 2007/0249259 | A1* | 10/2007 | Pham | A63H 5/00 446/224 |
| 2007/0289212 | A1 | 12/2007 | Shein | |
| 2008/0241445 | A1 | 10/2008 | Medeiros Santos et al. | |
| 2014/0246350 | A1 | 9/2014 | Wheeler | |
| 2014/0314970 | A1 | 10/2014 | Patrou et al. | |
| 2015/0135566 | A1 | 5/2015 | Simmons | |

* cited by examiner

BALLOON GREETING

This application is based on U.S. provisional application Ser. No. 62/457,505 title "BALLOON GREETING" filed Feb. 10, 2017 the priority of which is claimed.

FIELD OF THE INVENTION

The invention relates to greeting cards and gift cards, and in particular to a greeting or gift card with a balloon attached to it which is a self contained package, for in store sales, and which is convenient for a purchaser to carry, when purchased and inflated.

BACKGROUND OF THE INVENTION

Buying actual gifts for persons can be difficult. Greeting cards by themselves are a simple way of marking an anniversary or significant event. Often the donor of the card will want to add a gift to the card, in many cases a prepaid store gift card. However the greeting card by itself may appear to be some what too simple. The donor may like to make their gift stand out with a more festive device. Adding a greeting balloon can give a more festive air. Such balloons inflated with helium are readily available. They are printed with simple greeting messages and make an attractive addition to the occasion.

However the balloon will float away unless tethered to something else. Tying the tether to the balloon is tiresome.

It is desirable to provide a combination greeting balloon with a greeting card, which has sufficient mass to act as a tether. This card will connect and identify the balloon with the donor, and helps to personalise the greeting.

There are problems with this idea.

The cards and balloons are typically sold in stores carrying various gift items. The store owner will not wish to have the store cluttered with inflated balloons attached to cards. But the balloon must be inflated by someone in the store when it sold.

Packaging is provided for the greeting card and an uninflated balloon so that they can be handled for shipping and storage in the store and out on display, without becoming damaged.

BRIEF SUMMARY OF THE INVENTION

The answer is to provide an in store sales product which is a prepackaged greeting card with an uninflated balloon attached by a tether.

The customer can then select the appropriate greeting card and balloon with the desired message, take it to the cashier and pay.

The cashier can then inflate the balloon, and may place the greeting card and balloon in a shopping bag and hand it to the customer, but in most cases the shopping bag will not be required. The balloon remains attached to the greeting card by a captive tether. When the customer reaches his destination, he can hand the greeting card and balloon to the celebrant. The balloon can then be partly released and will float up on the tether above the greeting card. The greeting card will remain as the balloon anchor.

The greeting card is provided with a releasable temporary tab, by which the balloon after inflation in the store still remains securely on the greeting card at the time of purchase. Once delivered to the celebrant, the tab can be opened with a light tug and the balloon allowed to rise up on the tether.

This can be achieved by making a greeting card with several panels, folded together. One of the panels can be cut into some kind of elongated tether strip. When the balloon is released, the tether will unwind from the greeting card, but remain anchored, at the lower end of the tether, to the greeting card.

Preferably the tether will be cut from the card stock from which the greeting card is made, in the form of a spiral.

When unwound the spiral tether will provide a bounce action, so that the balloon will be able to float up and down in any air movement.

The greeting card panels may also provide a pocket to receive an item such as an in store prepaid gift card.

The balloon end of the tether strip remains securely attached to the balloon inflation tube.

The greeting card may also incorporate legs so that the greeting card can stand upright on a table.

The other end of the tether strip remains attached to the greeting card, and is preferably formed with a tail portion.

For security in the store, and to avoid damage to the greeting card, the greeting card is preferably placed in a sleeve of card stock. Preferably the sleeve forms part of a complete packaging system which will enclose the uninflated balloon, the gift card and the tether and also will provide an in-store tag by which the product can be hung on a store display tag board or the like.

The various features of novelty which characterizes the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

FIG. 1 a perspective front view of a greeting card and balloon as it will appear after delivery to the celebrant;

DESCRIPTION OF A SPECIFIC EMBODIMENT

Figure 1:
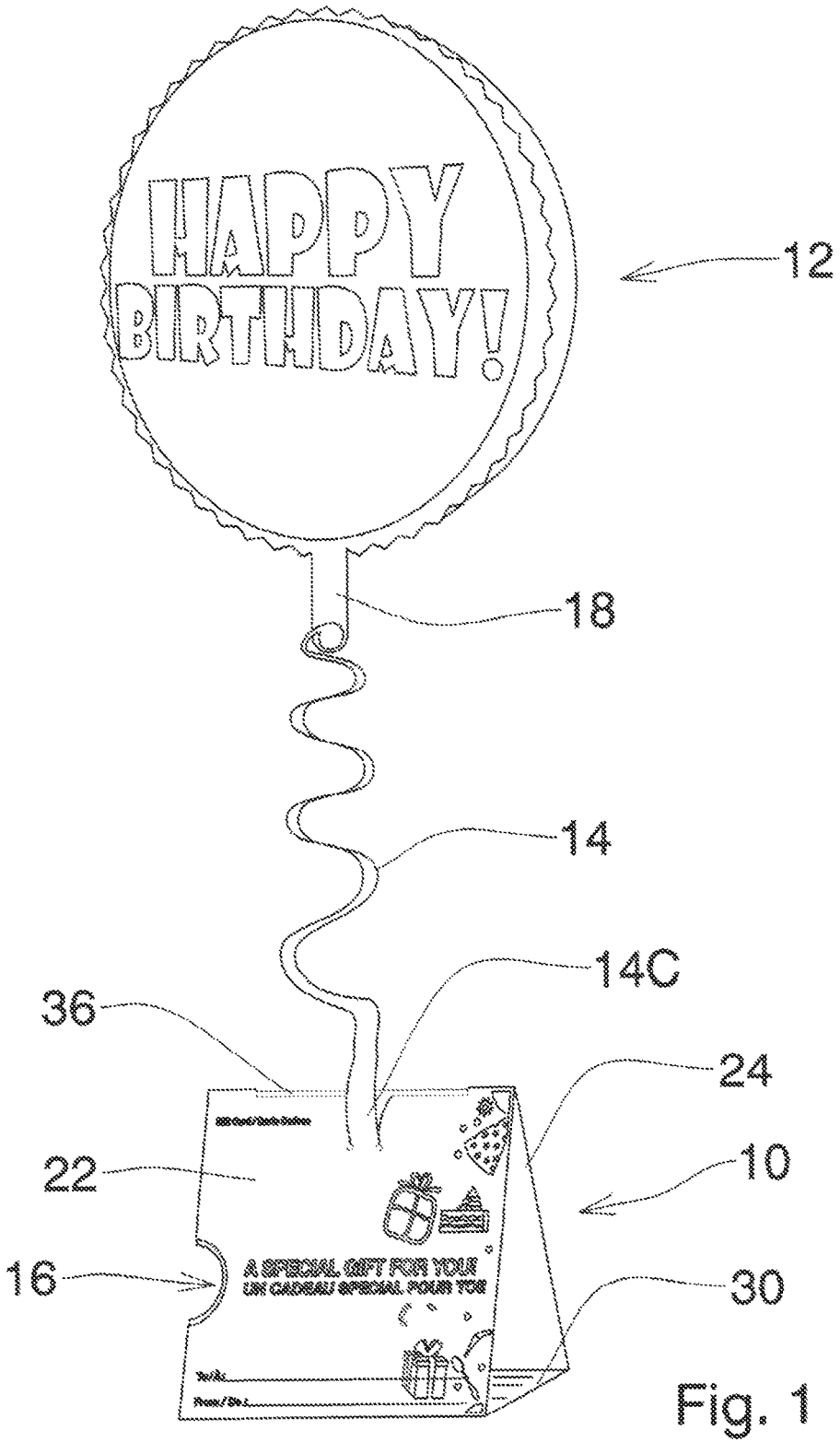
Figure 2:
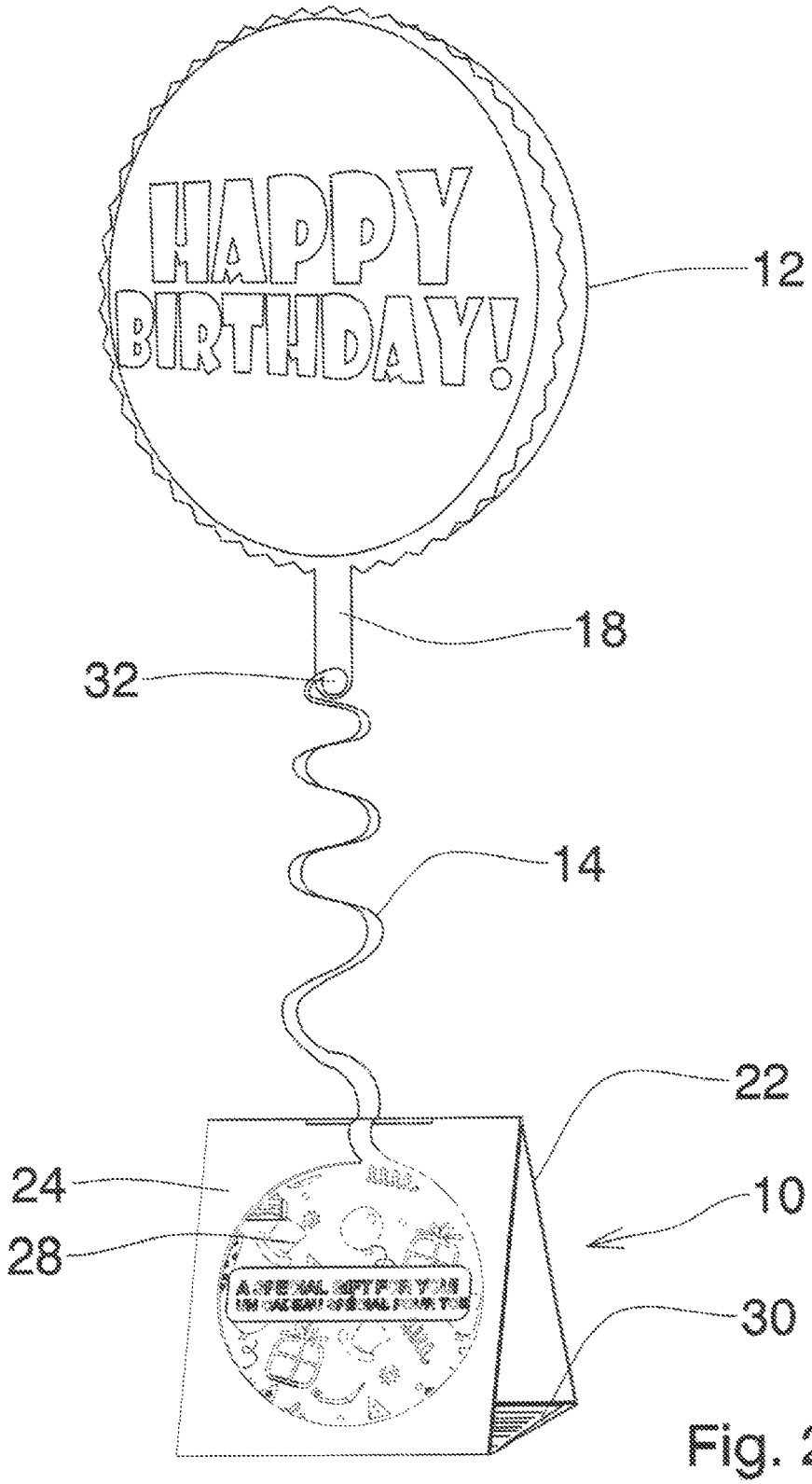
FIG. 2 is a perspective rear view of a greeting card and balloon as it will appear after delivery to the celebrant.

The greeting card and balloon as seen by the celebrant are shown in FIGS. 1. and 2 The greeting card (10) is standing on a surface. The balloon (12). fully inflated is floating up attached to the greeting card by a tether (14). The tether (14) in this case is a spiral strip cut into the card stock, from which the greeting card itself Is made.

The greeting card (10) has a thickness and weight sufficient to perform as an anchor, and has a pocket (16) shown in phantom for insertion of a gift of some kind such as an instore gift card.

Figure 3:
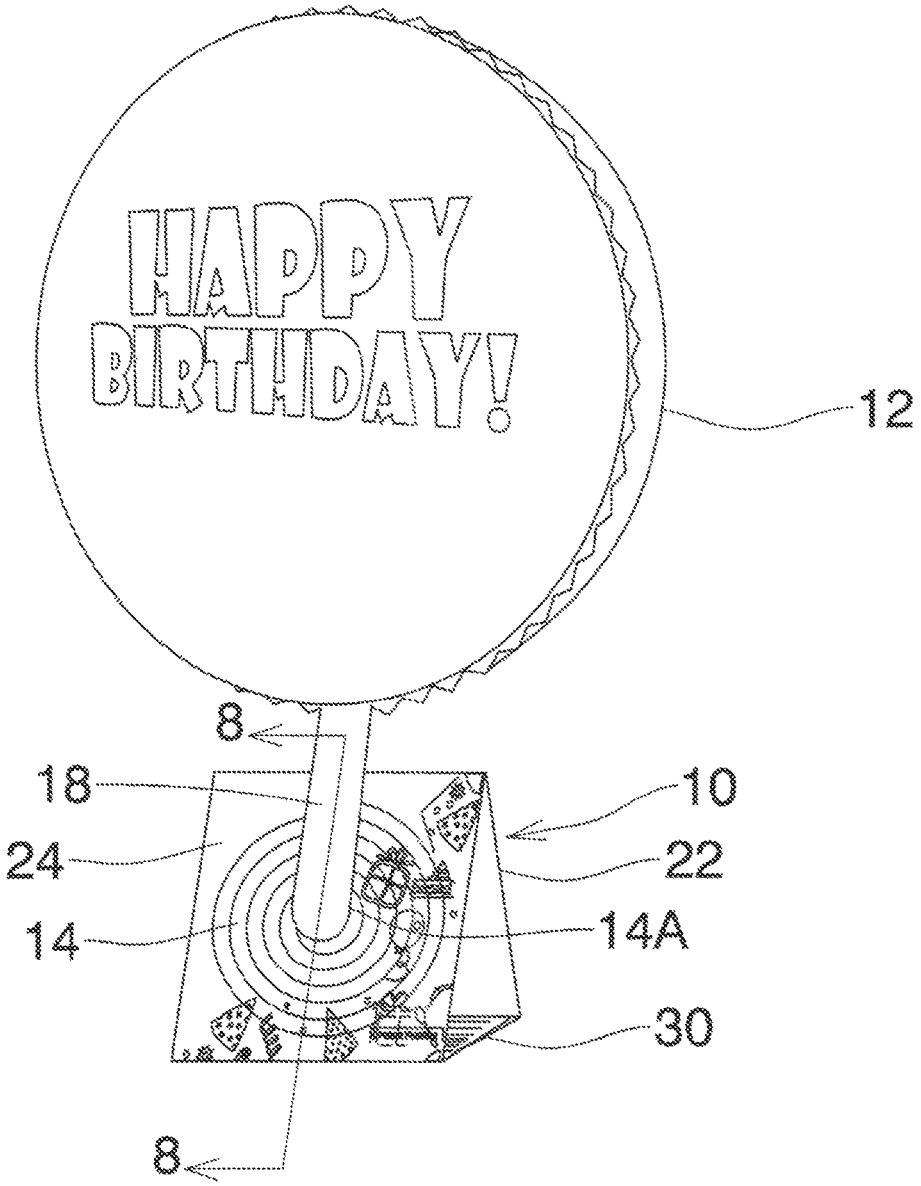
FIG. 3 is a perspective rear view of a greeting card and balloon, after in store inflation, ready for the customer to carry away.

FIG. 3 shows the greeting card (10) and balloon (12), after purchase and after inflation by the cashier, but before delivery to the celebrant.

At this point the balloon inflation tube (18) is still secured down to centre of the spiral tether (14) of the greeting card (10) by eg adhesive on the forwardly facing surface of the tether. The tether (14), at its centre, is secured by temporary adhesive located on the reverse or opposite surface of the tether to the centre to the card (10) to facilitate carrying away by the customer. This will prevent the balloon from escaping from the shopping bag. The panel end of the tether (14) remains integral with the material of the greeting card, in this embodiment.

Figure 4:
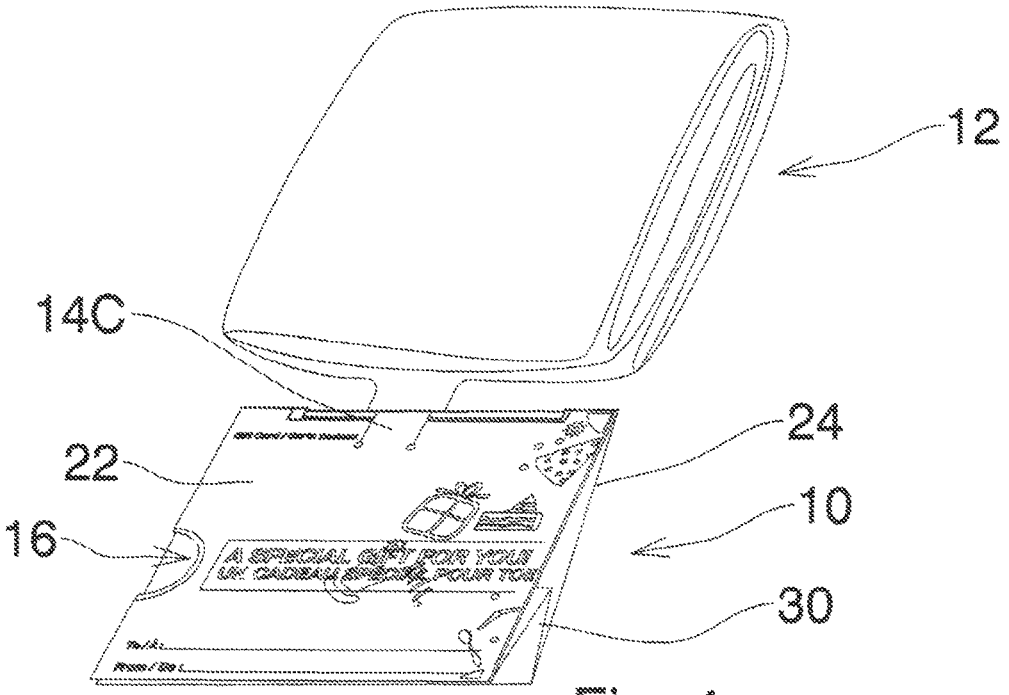
FIG. 4 is a perspective front view of a greeting card and balloon {uninflated} as it would appear as an in store item before purchase.

FIG. 4 shows the front of the package consisting of the card (10) folded flat, and the balloon (12) uninflated.

Figure 5:
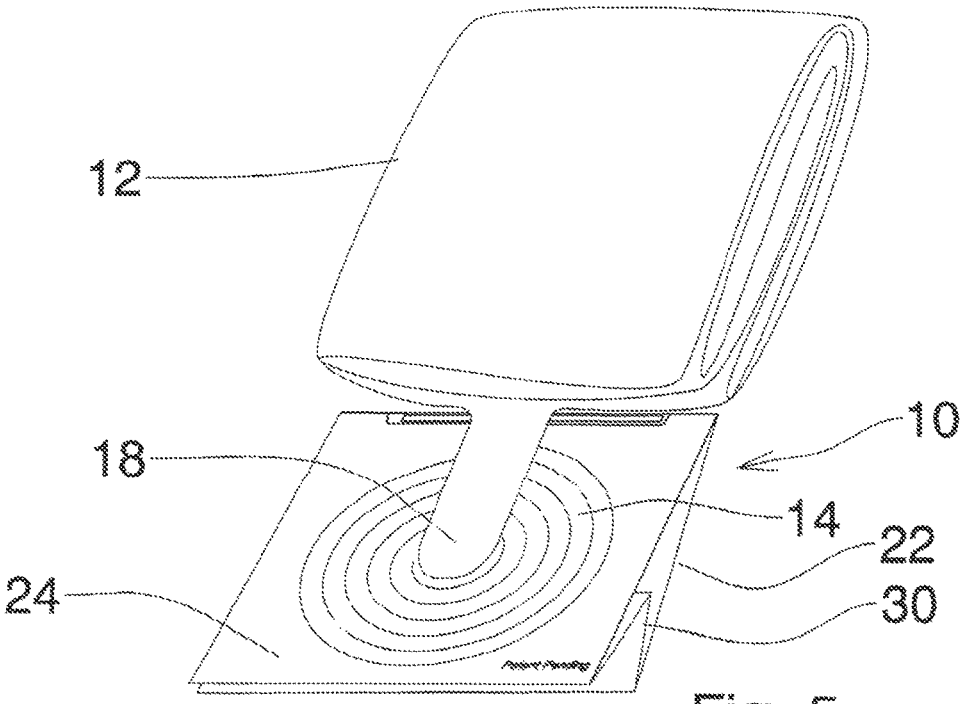
FIG. 5 is a perspective rear view of a greeting card and balloon {uninflated} as it would appear as an in store item before purchase.

FIG. 5 shows a rear view of the sales package consisting of the greeting card (10) and the balloon (12) which at this time is not inflated.

Figure 6:
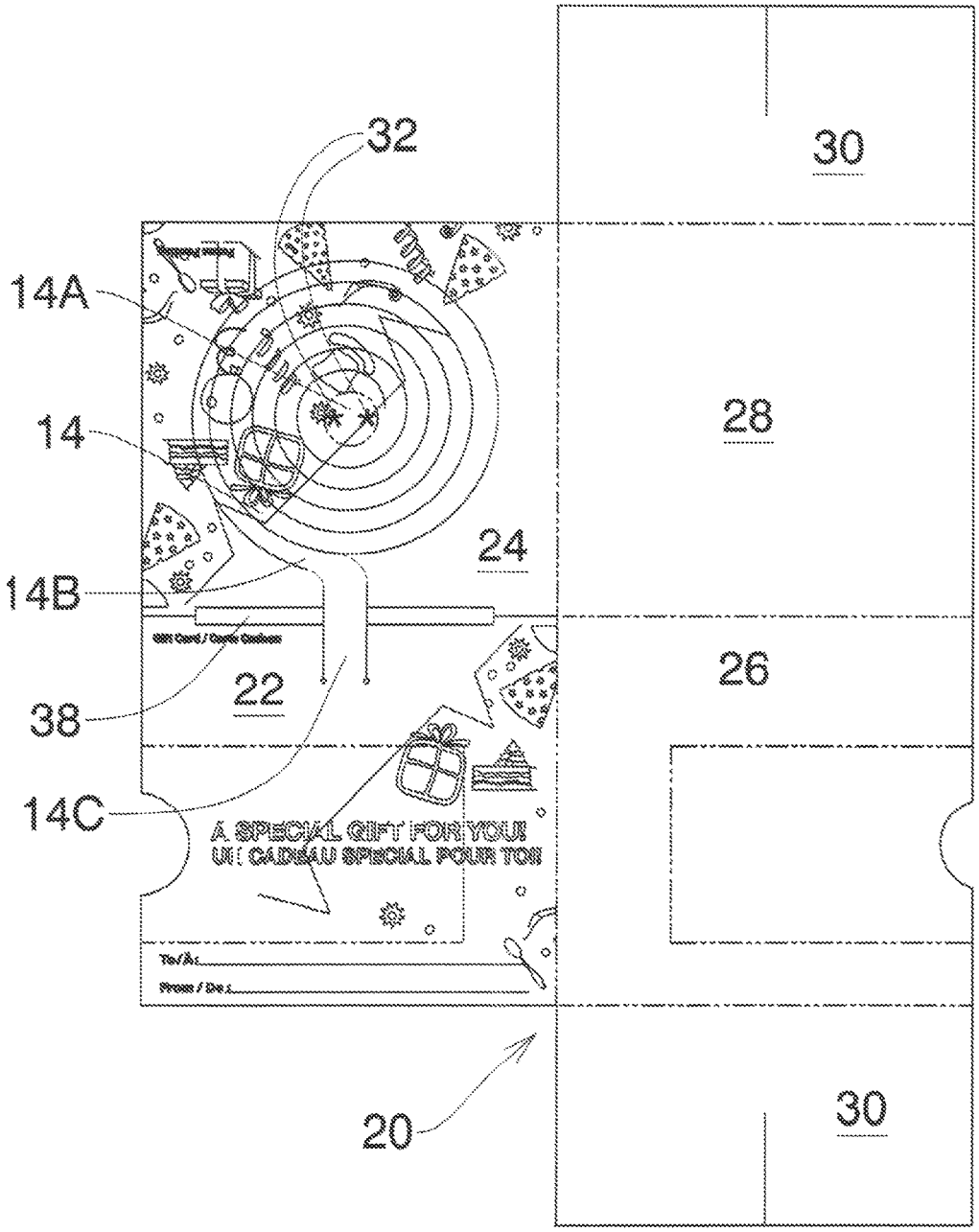
FIG. 6 is a plan view of the front face of the card stock for making the greeting card.

FIG. 6 shows the outer or front face of the card stock (20) from which the greeting card (10) is made.

Figure 7:
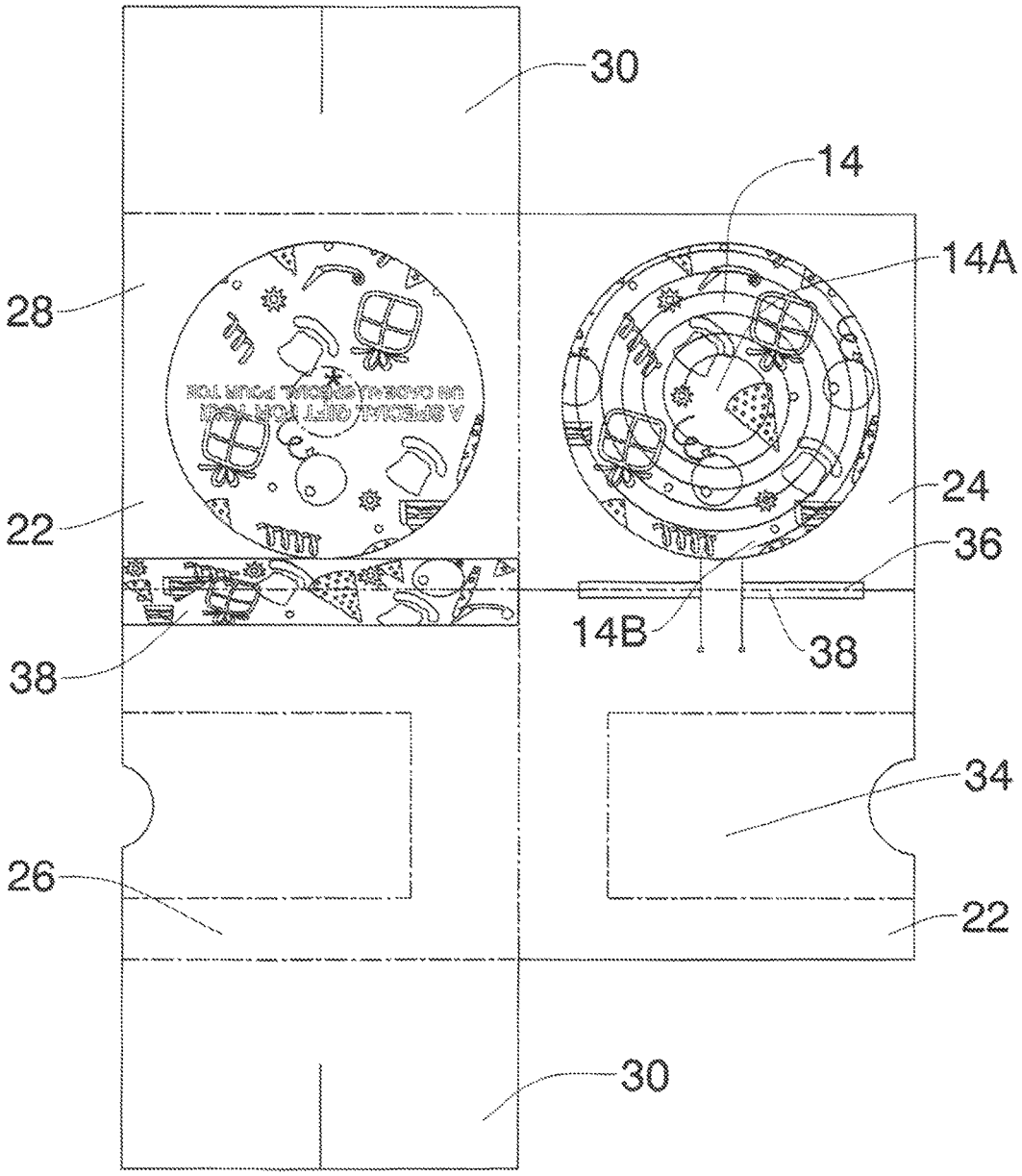
FIG. 7 is a plan view of the reverse face of the card stock of FIG. 6.

FIG. 7 shows the reverse or inner face of the card stock.

Figure 8:
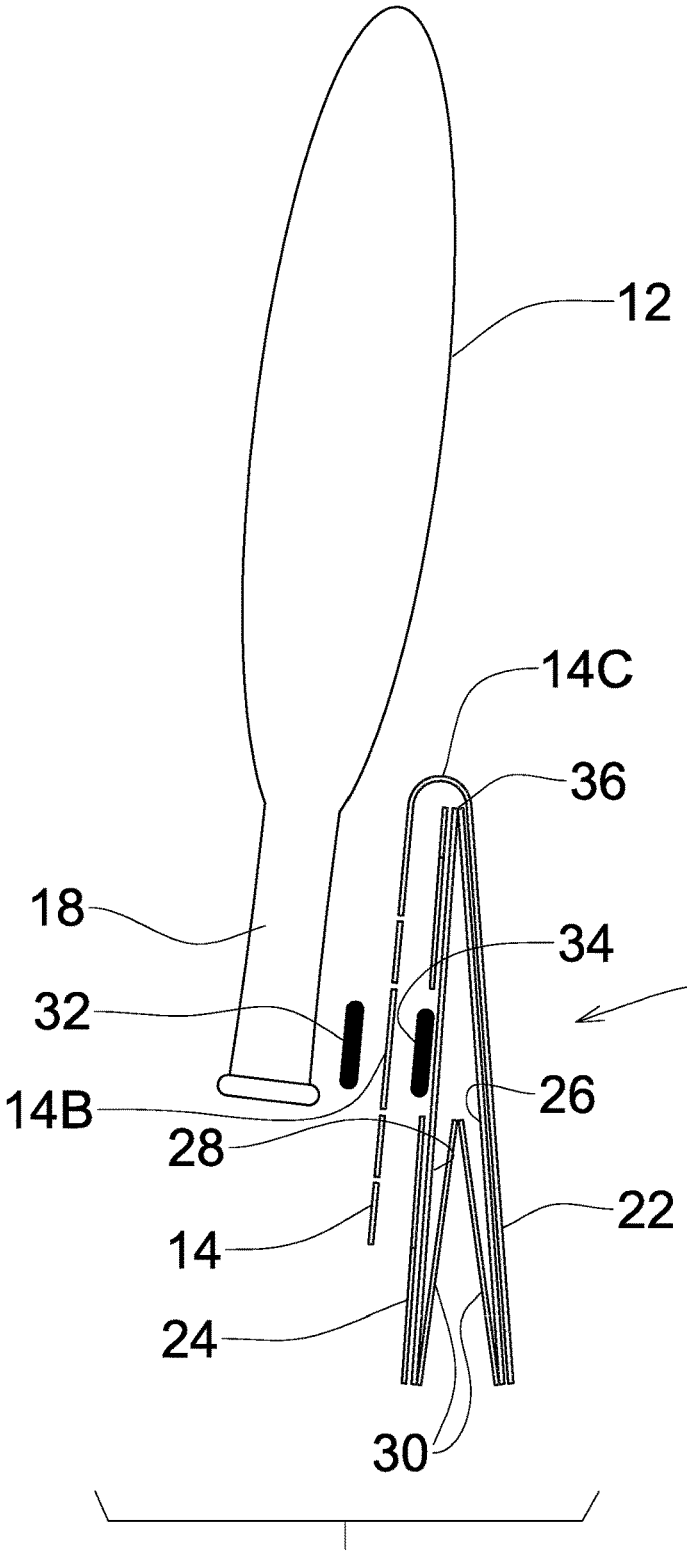
FIG. 8 is a schematic section partly exploded along 8-8 of FIG. 3.

FIG. 8 is s schematic section partly exploded along 8-8 of FIG. 3.

The card stock (20) has a front panel (22) and a rear panel (24). Two unfolded backing panels (26) and (28) will fold inwardly against the inward surfaces of front and rear panels (22) and (24).

Two leg panels (30) are attached to backing panels (26) and (28) and will fold and interlock together to provide a stand for standing a greeting card upright.

The tether (14) is cut from the rear panel (24), in a spiral shape in this case. The tether can be cut in various shapes, the intent being to provide a continuos strip to be attached to the balloon (12). For example a simple zig zag pattern could also possibly work.

The tether could also possibly be a separate piece of some filament, or might possibly be cut from a separate piece of stock, or plastic sheet, for example.

The tether (14) in this case, being a spiral shape, defines a central or tube tether end (14*a*), and an outer panel end (14*b*). The central end (14*a*) is the ultimate free end of the spiral. The panel end (14*b*) is where the tether merges with the card, and thus remains attached to the card.

The panel end (14*b*) is extended at tab (14*c*) and extends from the rear panel into the upper portion of the front panel. This provides a somewhat more durable form of attachment.

The balloon inflation tube (18) is secured by tube adhesive at (32) to the centre (14*a*) on the outwardly facing surface. of the spiral tether (14)

The rearward surface of the centre (14*a*) of the spiral tether (14) is adhered, by fugitive adhesive (34) to the backing panel (28). It will thus be seen that the fugitive adhesive (34) is on the opposite side of the centre (14*a*) to the tube adhesive (32). The balloon inflation tube (18) is thus secured to the outwardly facing face of the centre (14*a*) and the fugitive adhesive is located on the reverse side of centre (14*a*), holding the centre (14*a*) back against the backing panel (28). This fugitive adhesive (34) is only a temporary bond. It can be released, by the celebrant, by simply pulling on the inflation tube (18) of the balloon (12). This will then release the centre (14*a*) of the tether from temporary adhesive (34), and the balloon (12) will float up, extending the tether (14) as shown in FIG. 1. At this point, the tether (14) at its panel end (14*b*) remains attached to the card (10). The card (10) thus acts as an anchor holding the lower end of the tether, while the balloon (12) can float upwardly, but can not escape.

During manufacture the card stock is printed, and the outline is cut.

The panels (22) and (24) are separated by two narrow rectangular channels (36). These channels will enable the folding of the card stock, and avoids any distortion of the panels (22) and (24) due to the folding.

Between the two channels (36), the tail extension (14*c*) of the tether extends from the rear panel to the front panel. Tail (14*c*) is essentially oriented vertical, as this makes for a somewhat more durable connection with the card.

In operation, once the sheet of card stock has been printed, the two channels (36) are cut, and define the tail (14*c*) between them. The legs extending from the lower edges of the inner panels can be slit. At this point, the sheet of card stock has been folded so that the two inner panels fit against the inside of the panels (22) and (24). The sheet of card is then folded again so that the panel (22) is on the front of the greeting, and the panel (24) is on the rear. In this way, the two inner panels (26) and (28) are folded against one another, and are sandwiched between the panels (22) and (24). The greeting card, thus consists of four thicknesses of card stock. This provides sufficient weight for the greeting to secure the lower end of the tether on a table, for example, while allowing the balloon to float upwardly on the tether.

Once the greeting is delivered to the celebrant at the festive location, the two base leg portions (30) can be in folded, and interlocked together. The central slits are formed in the base legs to facilitate this inter engagement.

The die cutting of the tether (14) from panel (24) is a controlled depth cut so that only the actual panel (24) is cut. The backing panel (28) will lie under the tether (14), and will hold it flat, during packaging.

A rectangle of print (38), is made to fill the channels (36).

Note that the panel (28) is printed on its reverse face. This provides a decoration which is revealed when the tether (14) is extended.

Figure 9:
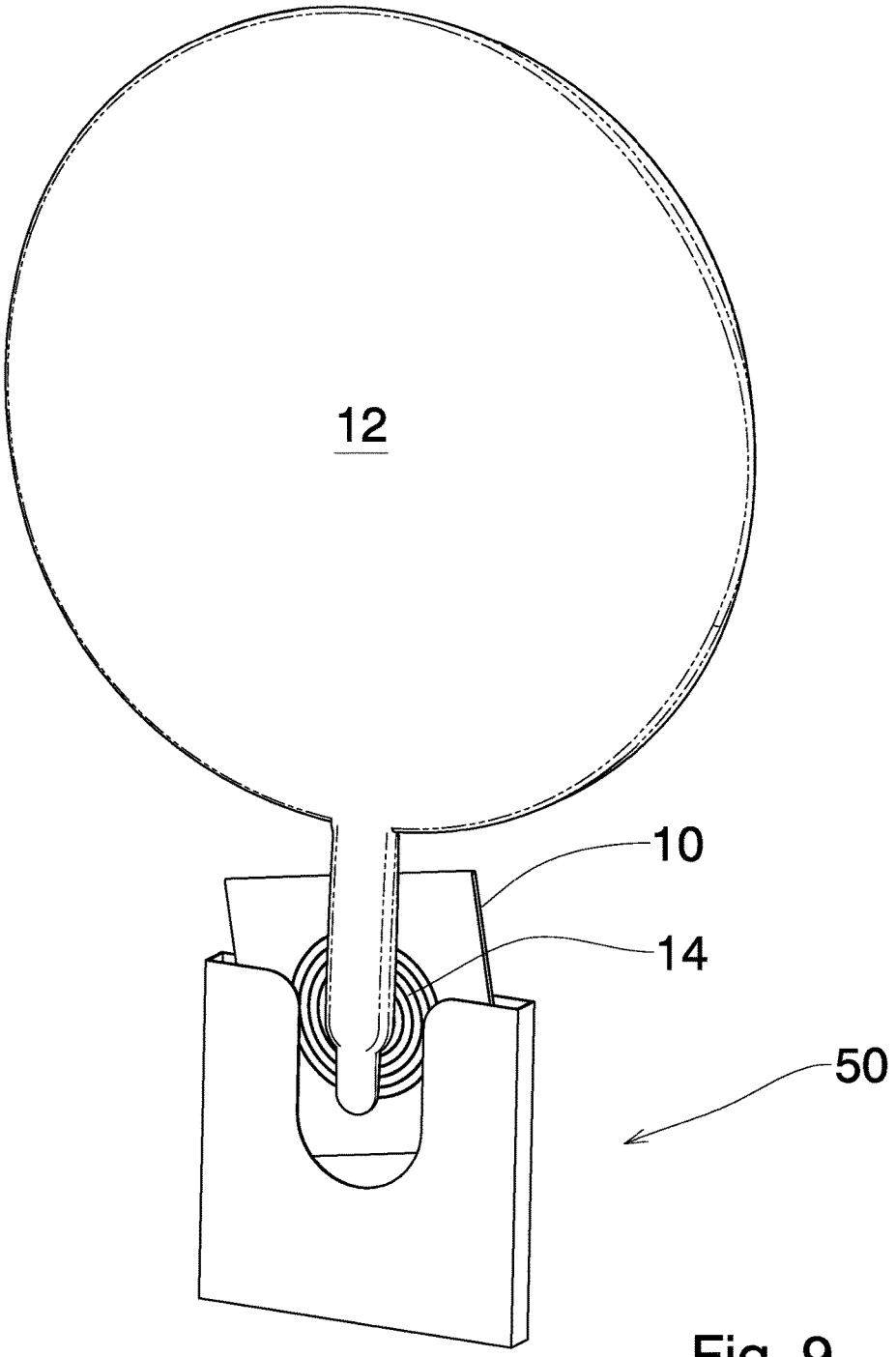
FIG. 9 is a perspective of the greeting card and protective sleeve which protects the greeting card until it is delivered to the celebrant.
Figure 10:
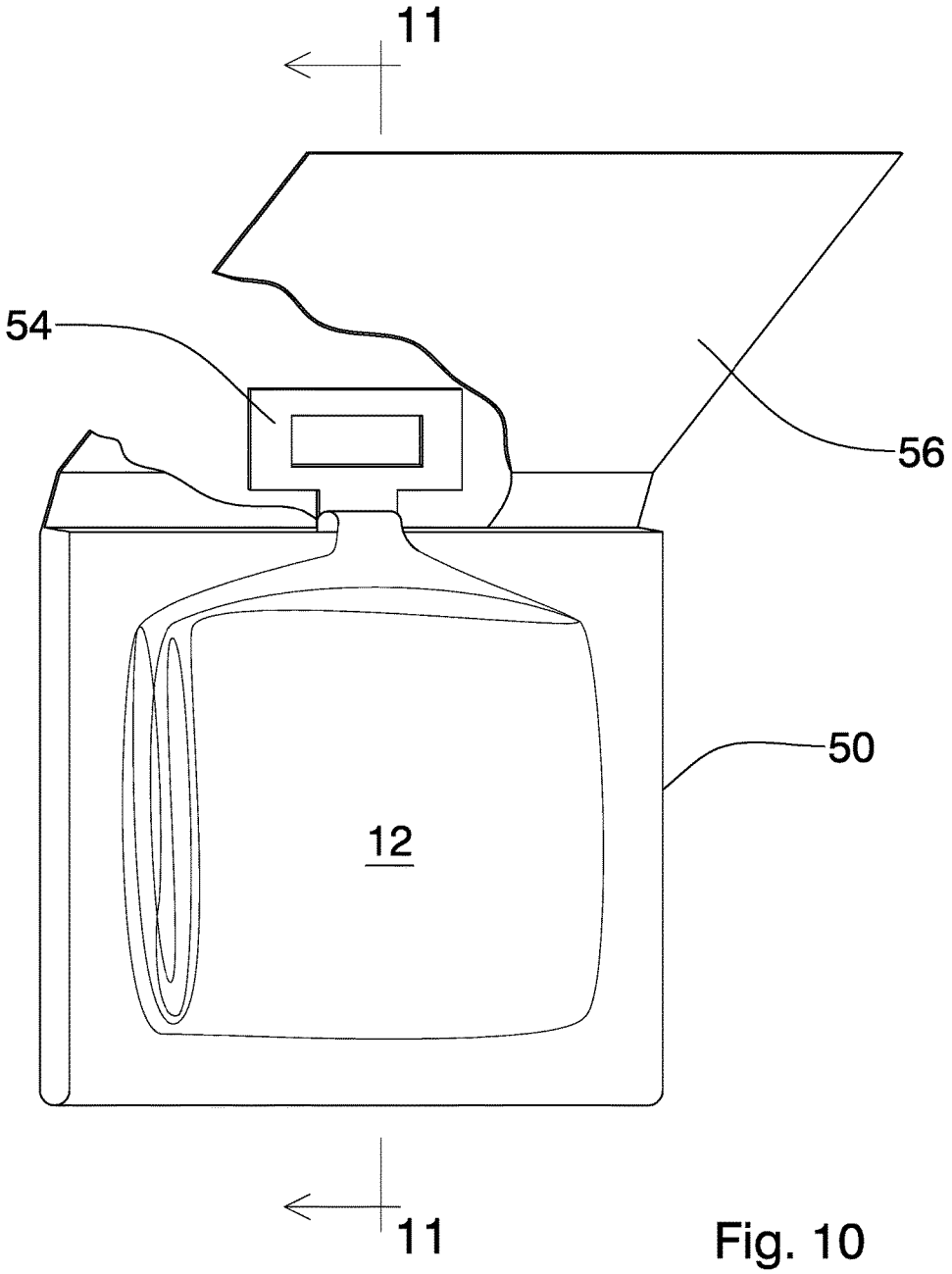
FIG. 10 is an illustration of a complete in-store package showing the greeting card and an uninflated balloon wrapped in a protective package and with a hang tag.
Figure 11:
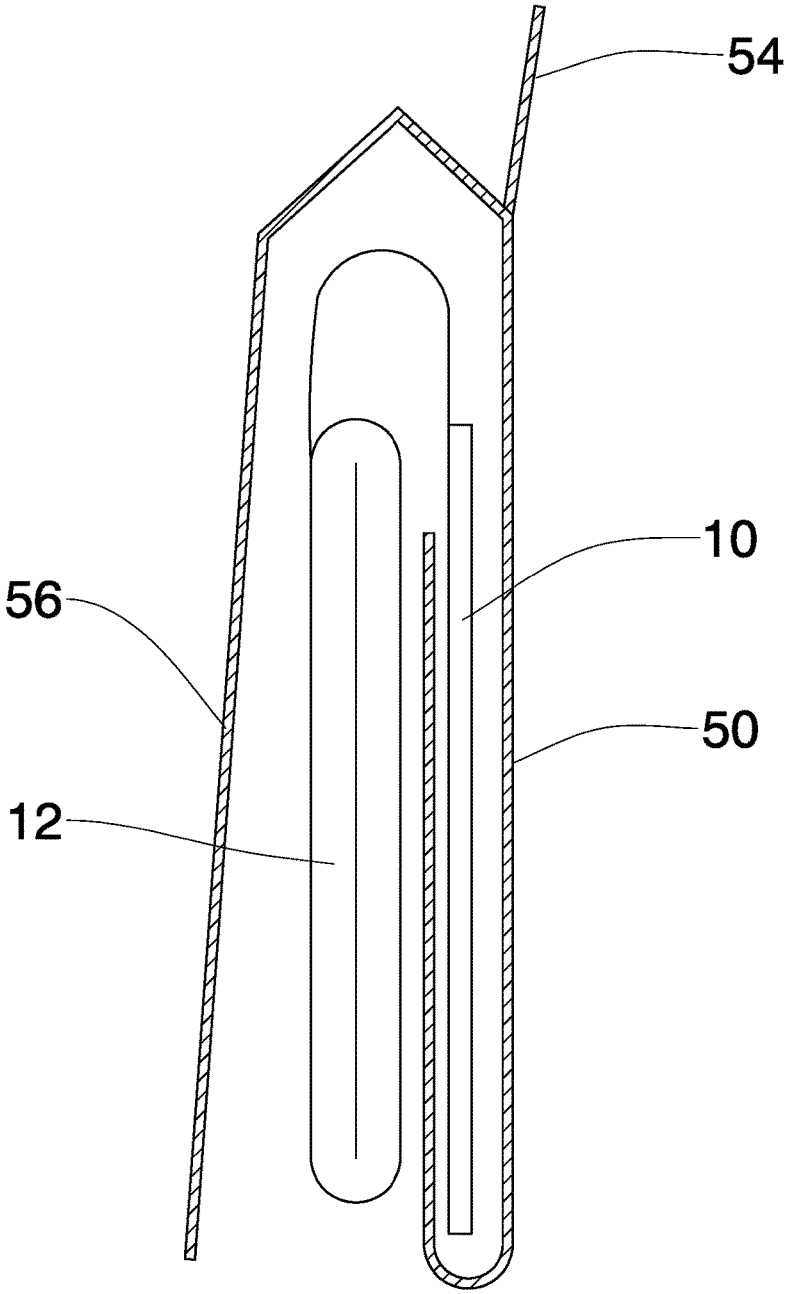
FIG. 11 is a section along line 11-11 of FIG. 10.

Until the greeting card is delivered to the celebrant, the card itself is safely contained within a sleeve (50) made of card stock or the like. Typically the sleeve will have an U-shaped opening at the edge (FIG. 9), through which the store clerk can have access to the inflation tube of the balloon.

As long as the entire greeting card and balloon remain on the store display or shelves, the entire greeting card and uninflated balloon are contained in a package enclosure consisting of a back panel (52) having a hang tag (54), and a front fold over cover (56). The sleeve (50) may be incorporated as part of the complete package. It will thus be seen that the greeting card is itself contained within the sleeve (50), and the folded over cover (56). The balloon uninflated is folded over and packaged on the front of the sleeve. The folded over cover (56) extends over the uninflated balloon.

Once the customer has chosen the appropriate balloon greeting card, and has taken it to the cashier, and has paid for it, the cashier will then simply rip off the folded over a portion (56) exposing the uninflated balloon. The store clerk will then inflate the balloon and hand the sleeve (50) containing the greeting card, with the balloon shown extended and inflated as in FIG. 8. The purchaser then takes the card with or without the shopping bag and hands it to the celebrant. The celebrant then removes the greeting card from the sleeve which is disposed of and releases the tether from the fugitive adhesive. The greeting card will then allow the balloon to float upwardly on the tether, and the greeting card will act as the anchor for the lower end of the tether.

The foregoing is a description of a preferred embodiment of the invention which is given here by way of example only.

What is claimed is:

1. A gift product having a greeting card and a balloon attached together, and comprising: an uninflated balloon adapted to be inflated for display; a tether element on said greeting card defining a first end and a second end and connected at said first end of said tether element to the greeting card, and secured at said second end of said tether element to a said balloon, and releasable securing means temporarily securing said balloon and said second tether end to said greeting card, said releasable securing means being releasable to release the balloon when inflated and allow said balloon to extend said second end of said tether element and to rise upwardly above said greeting card, while said tether first end remains anchored to the card; and wherein said tether element is part of said greeting card, and is formed of the same material as said greeting card.

2. The gift product as claimed in claim 1 wherein said tether element is cut from said greeting card material in the form of a spiral.

3. The gift product as claimed in claim 1 wherein said balloon is secured to said second end of said tether element, and including a fugitive adhesive temporarily holding said second end of said tether element onto said greeting card.

4. The gift product as claimed in claim 3 wherein said balloon has a balloon inflation tube, and wherein said balloon inflation tube is secured to said second end of said tether element.

5. The gift product as claimed in claim 1 wherein said greeting card comprises a plurality of panels, including a front greeting panel, a rear tether panel, and two inner panels folded inside said front greeting panel and said rear tether panel.

6. The gift product as claimed in claim 5 including leg panels formed on said inner panels, and slits formed in said leg panels which may be inter digitated together.

7. The gift product as claimed in claim 6 including channels formed between said front greeting panel and said rear tether panel.

8. The gift product as claimed in claim 7 including an area of printed material on a said inner panel, registering with said channels when said inner panels are folded within said front greeting panel and said rear tether panel.

9. The gift product as claimed in claim 8 wherein said tether element is in the form of a continuous spiral of card stock cut from said rear tether panel of said card, and wherein said spiral defines a centre portion on said second end of said tether element, and including a first adhesive on an outward face of said central tether end and bonded to said balloon inflation tube on said outward face of said centre portion of said tether element, and a fugitive second adhesive on an opposite face of said centre portion of said tether element temporarily holding said centre portion of said tether element to one of said inner panels.

10. The gift product as claimed in claim 9 wherein said spiral tether element defines a centre end portion, and a panel end portion, and wherein said centre end portion of said tether element is attached to a balloon inflation tube, and wherein said panel end portion of said spiral tether element is attached to said front panel of said greeting card.

11. A gift product having a greeting card and a balloon attached together, and comprising:

an uninflated balloon adapted to be inflated for display;

and wherein said greeting card comprises a plurality of panels, including a front greeting panel, a rear tether panel, and two inner panels adapted to be folded inside said front greeting panel and rear tether panel;

a tether element on said rear tether panel of said greeting card said tether element defining a first tether element end and a second tether element end;

a tether extension tail on said tether extending from said rear tether panel into a portion of said front greeting panel;

wherein said tether extension tail forms said first tether element end and is attached to said front face of said greeting card;

a balloon inflation tube on said balloon;

a first adhesive securing said balloon inflation tube to a first face of said second tether element end of said tether element; and, releasable securing means temporarily holding a second face of said second tether element end of said tether element to said greeting card, said releasable securing means being releasable to permit the balloon when inflated and said tether element to extend upwardly above said greeting card.

12. The gift product as claimed in claim 11 and including a protective sleeve, and said greeting card being placed in said protective sleeve for security during sales and delivery.

13. The gift product as claimed in claim 12 including a hang tag attached to said sleeve whereby said sleeve may be placed on display holding said greeting card and balloon ready for purchase.

14. The gift product as claimed in claim 13 and including a cover portion attached to said sleeve and adapted to fold over said uninflated balloon and protect and secure said balloon during display and handling in a store.

* * * * *